US008689747B2

(12) United States Patent
Kobayashi et al.

(10) Patent No.: US 8,689,747 B2
(45) Date of Patent: Apr. 8, 2014

(54) VALVE TIMING CONTROL DEVICE

(75) Inventors: Masaki Kobayashi, Okazaki (JP); Mitsuru Uozaki, Obu (JP)

(73) Assignee: Aisin Seiki Kabushiki Kaisha, Kariya-Shi, Aichi-Ken (JP)

( * ) Notice: Subject to any disclaimer, the term of this patent is extended or adjusted under 35 U.S.C. 154(b) by 162 days.

(21) Appl. No.: 13/375,857

(22) PCT Filed: Feb. 16, 2010

(86) PCT No.: PCT/JP2010/052274

§ 371 (c)(1),
(2), (4) Date: Dec. 2, 2011

(87) PCT Pub. No.: WO2011/036903

PCT Pub. Date: Mar. 31, 2011

(65) Prior Publication Data

US 2012/0085303 A1 Apr. 12, 2012

(30) Foreign Application Priority Data

Sep. 25, 2009 (JP) ..... 2009-220653

(51) Int. Cl.
*F01L 1/34* (2006.01)

(52) U.S. Cl.
USPC ..... 123/90.17

(58) Field of Classification Search
USPC ..... 123/90.15, 90.17; 464/160, 161
See application file for complete search history.

(56) References Cited

U.S. PATENT DOCUMENTS 6,439,184 B1 * 8/2002 Takenaka et al. ..... 123/90.17
6,457,447 B1 * 10/2002 Sato et al. ..... 123/90.17

(Continued)

FOREIGN PATENT DOCUMENTS

CN 101031703 A 9/2007
JP 2000-345816 A 12/2000

(Continued)

OTHER PUBLICATIONS

International Search Report (PCT/ISA/210) issued on Mar. 23, 2010, by Japanese Patent Office as the International Searching Authority for International Application No. PCT/JP2010/052274.

(Continued)

*Primary Examiner* — Thomas Denion
*Assistant Examiner* — Daniel Bernstein
(74) *Attorney, Agent, or Firm* — Buchanan Ingersoll & Rooney PC

(57) ABSTRACT

A valve timing control device comprises a drive-side rotational member synchronously rotatable with a crankshaft of an internal combustion engine; a driven-side rotational member mounted coaxially with the drive-side rotational member and synchronously rotatable with a camshaft for opening and closing a valve of the internal combustion engine; a fluid pressure chamber defined by the drive-side rotational member and the driven-side rotational member; a partition provided in at least one of the drive-side rotational member and the driven-side rotational member for dividing the fluid pressure chamber into a retarded angle chamber and an advanced angle chamber; a fluid feeding/discharging mechanism for controlling feed/discharge of working fluid relative to the fluid pressure chamber; a locking mechanism for restricting a relative rotational phase of the driven-side rotational member relative to the drive-side rotational member to a predetermined phase between a most retarded angle phase and a most advanced angle phase; and an urging mechanism for constantly exerting an urging force to the drive-side rotational member and the driven-side rotational member to displace the relative rotational phase to the side of the most retarded angle phase.

4 Claims, 9 Drawing Sheets

(56) References Cited

U.S. PATENT DOCUMENTS

| | | | | |
|---|---|---|---|---|
| 7,100,555 | B2 | 9/2006 | Imaizumi et al. | |
| 7,198,014 | B2 | 4/2007 | Kanada et al. | |
| 2001/0039933 | A1* | 11/2001 | Sato et al. | 123/90.17 |
| 2002/0043230 | A1 | 4/2002 | Kinugawa | |
| 2005/0016482 | A1 | 1/2005 | Kobayashi et al. | |
| 2006/0130790 | A1 | 6/2006 | Kanada et al. | |
| 2006/0231053 | A1 | 10/2006 | Tada | |
| 2007/0266970 | A1 | 11/2007 | Ogawa | |

FOREIGN PATENT DOCUMENTS

| | | | |
|---|---|---|---|
| JP | 2001-098910 | A | 4/2001 |
| JP | 2002-061504 | A | 2/2002 |
| JP | 2003-120229 | A | 4/2003 |
| JP | 2006-170085 | A | 6/2006 |
| JP | 2009-024563 | A | 2/2009 |
| JP | 2009-114999 | A | 5/2009 |

OTHER PUBLICATIONS

Written Opinion (PCT/ISA/237) issued on Mar. 23, 2010, by Japanese Patent Office as the International Searching Authority for International Application No. PCT/JP2010/052274.

Notification of Transmittal of Translation of the International Preliminary Report on Patentability(Chapter I or Chapter II)(PCT/IB/338), International Preliminary Report on Patentability (PCT/IB/373) and the Written Opinion of the International Searching Authority (Form PCT/ISA/237) issued on Apr. 11, 2012, in the corresponding International Application No. PCT/JP2010/052274. (6 pages).

Chinese Notification of the First Office Action dated Oct. 24, 2013 issued in the corresponding Chinese Patent Application No. 201080023963.3 and English language translation.

* cited by examiner

VALVE TIMING CONTROL DEVICE

TECHNICAL FIELD

The present invention relates to a valve timing control device for regulating opening/closing timing of an intake valve and an exhaust valve of an internal combustion engine used in an automobile, and more particularly, to the valve timing control device comprising a drive-side rotational member synchronously rotatable with a crankshaft; a driven-side rotational member mounted coaxially with the drive-side rotational member and synchronously rotatable with a camshaft for opening and closing of the valve of the internal combustion engine; a fluid pressure chamber defined by the drive-side rotational member and the driven-side rotational member; a partition provided in at least one of the drive-side rotational member and the driven-side rotational member for dividing the fluid pressure chamber into a retarded angle chamber and an advanced angle chamber; a fluid control mechanism for controlling feed/discharge of working fluid relative to the fluid pressure chamber; and a locking mechanism for restricting a relative rotational phase of the driven-side rotational member relative to the drive-side rotational member to a predetermined phase between a most retarded angle phase and a most advanced angle phase.

BACKGROUND ART

As disclosed in Patent Document 1, there has been a conventional valve timing control device comprising a drive-side rotational member (corresponding to a "shoe housing" in Patent Document 1), a driven-side rotational member (corresponding to a "vane rotor" in Patent Document 1), a fluid pressure chamber (corresponding to a "storing chamber" in Patent Document 1) defined by the drive-side rotational member and the driven-side rotational member, a partition (corresponding to a "vane" in Patent Document 1) provided in the driven-side rotational member for dividing the fluid pressure chamber into the retarded angle chamber and the advanced angle chamber, a fluid control mechanism (corresponding to an "oil pump", "switching valve" and "drain" in Patent Document 1) for controlling feed/discharge of the working fluid relative to the fluid pressure chamber, and a locking mechanism (corresponding to a "restricting member" in Patent Document 1) for restricting the relative rotational phase of the driven-side rotational member relative to the drive-side rotational member to the predetermined phase between the most retarded angle phase and the most advanced angle phase.

According to the invention disclosed in Patent Document 1, the relative rotational phase can be reliably set to an optimum initial phase when the engine is started based on the operation of the locking mechanism. Thus, the intake timing and the ignition timing of the engine are optimized to provide a low-emission engine with reduced harmful combustion emissions, e.g., hydrocarbon (HC).

Further, while the engine is driving, a displacement force applied in the retarded angle direction and a displacement force applied in the advanced angle direction based on torque variations of the camshaft are usually exerted to the driven-side rotational member. The displacement force is exerted in the retarded angle direction on average, which causes the driven-side rotational member to displace in the retarded angle direction. Hereinafter, the average of both the displacement force applied in the retarded angle direction and the displacement force applied in the advanced angle direction based on the torque variations of the camshaft will be referred to as an "average displacement force applied in the retarded angle direction based on the torque variations of the camshaft." The valve timing control device disclosed in Patent Document 1 is provided with an advanced angle member for adding torque to the driven-side rotational member in the advanced angle direction, thereby to allow the relative rotational phase to displace smoothly and quickly in the advanced angle direction regardless of the average displacement force applied in the retarded angle direction based on the torque variations of the camshaft.

PRIOR ART DOCUMENT

Patent Document

Patent Document 1: Japanese Unexamined Patent Application Publication No. 2000-345816

SUMMARY OF THE INVENTION

Technical Problem to be Solved by the Invention

Recently, improvement on fuel consumption of the internal combustion engine has been required in order to cope with various environmental problems. With this trend, a pump for feeding the working fluid has been miniaturized and reduced in capacity, which has decreased feeding pressure of the working fluid relative to the fluid pressure chamber. Therefore, it is desired to develop the valve timing control device that can establish a proper driving state particularly even when the feeding pressure is low. During the idling state, in particular, rotational speed of the internal combustion engine is low and the feeding pressure of the working fluid is considerably low. Further, in such a state, the temperature of the working fluid is increased while the viscosity is reduced, in which the fluid pressure is less easily transmitted. As a result, the driven-side rotational member would easily clatter in the retarded angle direction and the advanced angle direction due to the displacement force applied in the retarded angle direction and advanced angle direction based on the torque variations.

In the valve timing control device provided in the intake side, the relative rotational phase is mostly set to a phase in the vicinity of the most retarded angle phase when the engine is rotated at low speed in the idling state, for example. Therefore, if the pump is miniaturized and reduced in capacity in the valve timing control device disclosed in Patent Document 1, it would be difficult to stably maintain the driven-side rotational member in the phase in the vicinity of the most retarded angle phase, since the feeding pressure of the working fluid is considerably low during the idling state, in addition to that the advanced angle member is provided to cancel the average displacement force applied in the retarded angle direction based on the torque variations of the camshaft. As a result, the driven-side rotational member clatters, which sometimes hampers achievement of the stable idling state. Further, an unusual sound might be produced due to clattering of the partition.

In order to solve the above-noted problem, it is considered that the fluid pressure chamber and the partition are enlarged or the number of fluid pressure chamber is increased to increase a pressure-receiving area of the partition that receives the fluid pressure. However, such a solution would result in enlargement of the valve timing control device, which cannot deal with the above-noted technical problem.

The object of the present invention is to provide a valve timing control device capable of achieving low emissions when the internal combustion engine is started and providing a stable idling state even when the feeding pressure of the working fluid is low.

Solution to the Problem

A first characteristic feature of the valve timing control device according to the present invention lies in comprising a drive-side rotational member synchronously rotatable with a crankshaft of an internal combustion engine; a driven-side rotational member mounted coaxially with the drive-side rotational member and synchronously rotatable with a camshaft for opening and closing a valve of the internal combustion engine; a fluid pressure chamber defined by the drive-side rotational member and the driven-side rotational member; a partition provided in at least one of the drive-side rotational member and the driven-side rotational member for dividing the fluid pressure chamber into a retarded angle chamber and an advanced angle chamber; a fluid feeding/discharging mechanism for controlling feed/discharge of working fluid relative to the fluid pressure chamber; a locking mechanism for restricting a relative rotational phase of the driven-side rotational member relative to the drive-side rotational member to a predetermined phase between a most retarded angle phase and a most advanced angle phase; and an urging mechanism for constantly exerting an urging force to the drive-side rotational member and the driven-side rotational member to displace the relative rotational phase to the side of the most retarded angle phase.

With the above-noted arrangement, the urging force produced by the urging mechanism and the average displacement force applied in the retarded direction based on the torque variations of the camshaft are constantly exerted on the driven-side rotational member as a force to relatively rotate and move the driven-side rotational member in the retarded angle direction. Thus, even if an idling state is established after the internal combustion engine is properly started with the relative rotational phase being restricted to the predetermined phase by the locking mechanism, and then the fluid pressure received by the partition is reduced, the relative rotational phase is stabilized at the most retarded angle phase or a phase in the vicinity of the most retarded angle phase due to the above-noted urging force and the above-noted average displacement force applied in the regarded angle direction based on the torque variations of the camshaft. As a result, even if a pump, for example, of the fluid feeding/discharging mechanism is reduced in capacity, the idling state can be stabilized.

A second characteristic feature of the valve timing control device according to the present invention lies in that the strength of the urging force is determined in such a manner that a sum of the urging force and a displacement force composed of fluid pressure of the working fluid exerted on the partition from the side of the retarded angle chamber when the internal combustion engine is driven at a predetermined rotational speed, is greater than a component displacement force applied in an advanced angle direction of a displacement force exerted on the driven-side rotational member based on torque variations of the camshaft when the internal combustion engine is driven at the predetermined rotational speed, and that the urging force is equal to or less than the component displacement force applied in the advanced angle direction of the displacement force exerted on the driven-side rotational member based on the torque variations of the camshaft when the internal combustion engine is driven at the predetermined rotational speed.

With the above-noted arrangement, when the internal combustion engine is driven at the predetermined rotation speed, e.g., at low speed during the idling state, the component displacement force applied in the advanced angle direction of the displacement force based on torque variations of the camshaft is canceled by the urging force of the urging mechanism applied in the retarded angle direction even if the feeding pressure of the working fluid for maintaining the relative rotational phase in the phase in the vicinity of the most retarded angle phase is low. Thus, the driven-side rotational member is free from clattering, which stabilizes the idling state.

On the other hand, when the rotational speed of the internal combustion engine is less than the predetermined rotational speed, e.g., when the internal combustion engine is stopped, the pump is stopped to eliminate the fluid pressure, and thus the displacement force applied in the advanced angle direction becomes greater than the urging force of the urging mechanism applied in the retarded angle direction. As a result, the driven-side rotational member would clatter in the retarded angle direction and advanced angle direction until the camshaft completely comes to stop. With the arrangement of the present invention, the relative rotational phase can be displaced to the predetermined phase using clattering of the driven-side rotational member when the engine is stopped. Therefore, the relative rotational phase can be restricted to the predetermined phase by the locking mechanism. In addition, when the internal combustion engine is stopped in any abnormal situation, the driven-side rotational member would clatter by cranking in restarting the internal combustion engine, which allows the relative rotational phase to be restricted to the predetermined phase by the locking mechanism. In this way, the relative rotational phase can be restricted to the predetermined phase based on the normal operations of the valve timing control device simply by determining the strength of the urging force properly without performing any special control to prepare for restart of the internal combustion engine.

It should be noted that "the displacement force composed of fluid pressure of the working fluid exerted on the partition from the side of the retarded angle chamber" represents the magnitude of a displacement force derived by multiplying "the fluid pressure of the working fluid exerted on each partition from the side of the retarded angle chamber" by "a distance between a central point of application of the fluid pressure in the partition and the rotational axis" and "the number of partitions."

A third characteristic feature of the valve timing control device according to the present invention lies in that the strength of the urging force is determined to be at or greater than a component displacement force applied in an advanced angle direction of a displacement force exerted on the driven-side rotational member based on torque variations of the camshaft when the internal combustion engine is driven at the predetermined rotational speed.

In some cases, when the internal combustion engine is stopped, control is performed to displace the relative rotational phase to the predetermined phase without stopping the internal combustion engine immediately and then allow the internal combustion engine to stop after the restriction by the locking mechanism is confirmed. In such a case, it is not required in the device of the present invention to displace the relative rotational phase to the predetermined phase using clattering of the driven-side rotational member as noted above. With the arrangement of the present invention, the component displacement force applied in the advanced angle direction of the displacement force based on the torque variations of the camshaft is always canceled by the urging force of the urging mechanism when the internal combustion engine is driven at or less than the predetermined rotational speed, e.g. during the idling state. Thus, no clattering occurs in the driven-side rotational member to reliably stabilize the idling operation. In addition, the arrangement provided by this feature facilitates setting of the strength of the urging force of the urging mechanism.

A fourth characteristic feature of the valve timing control device according to the present invention lies in that the internal combustion engine is capable of being started when the relative rotational phase is at the most retarded angle phase.

In the arrangement in which the relative rotational phase is defined as the predetermined phase between the most retarded angle phase and the most advanced angle phase where hydrocarbon can be reduced when the internal combustion engine is started, for example, and then the relative rotational phase is restricted to the predetermined phase by the locking mechanism after the internal combustion engine is stopped or restarted, there is a possibility that the restriction by the locking phase cannot be achieved. When the internal combustion engine is started, for example, the relative rotational phase is at the locking phase in many cases. In the arrangement of the present invention, the engine can be started even if the relative rotational phase is at the most retarded angle phase, and thus there is no hindrance in operation per se.

MODES FOR CARRYING OUT THE INVENTION

The present invention will be described hereinafter in reference to FIGS. 1-5 with respect to an embodiment in which a valve timing control device relating to the present invention is applied to an automobile engine adjacent to an intake valve. The automobile engine corresponds to an "internal combustion engine" of the present invention.

[Overall Structure]

Figure 1:
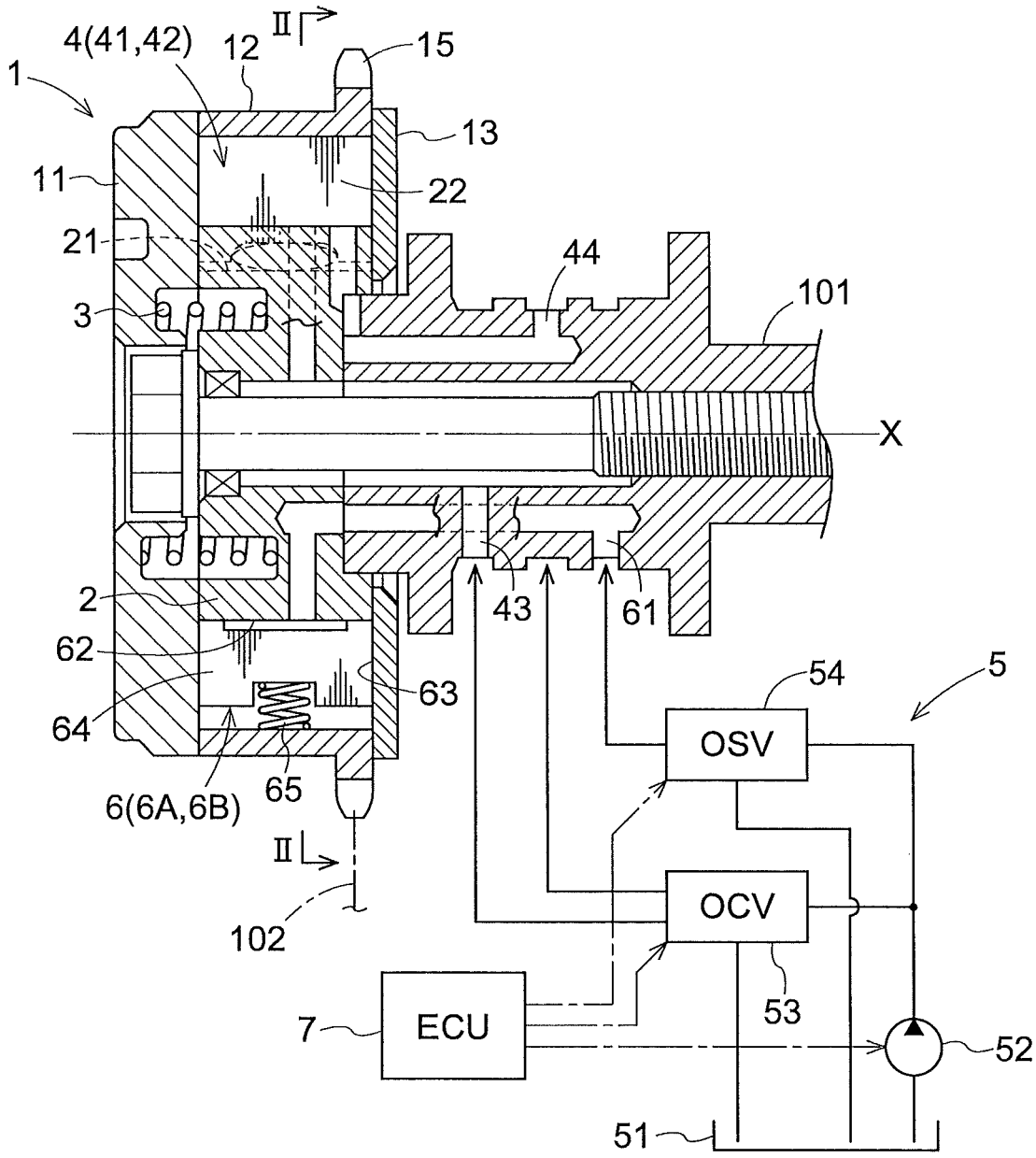
FIG. 1 shows an overall structure of a valve timing control device according to the present invention.

As shown in FIG. 1, the valve timing control device includes a housing 1 acting as a "drive-side rotational member" that is synchronously rotatable relative to a crankshaft (not shown) of an engine, and an inner rotor 2 mounted coaxially with the housing 1 and acting as a "driven-side rotational member" that is synchronously rotatable relative to a camshaft 101. The camshaft 101 represents a rotary shaft of a cam (not shown) for controlling opening and closing of the intake valve of the engine. The camshaft 101 is rotatably assembled to a cylinder head (not shown) of the engine.

Further, the valve timing control device includes a locking mechanism 6 capable of restricting a relative rotational phase of the inner rotor 2 to the housing 1 to a predetermined phase between the most retarded angle phase and the most advanced angle phase by restricting relative rotational movement of the inner rotor 2 to the housing 1.

[Inner Rotor and Housing]

As shown in FIG. 1, the inner rotor 2 is assembled integrally with a distal end portion of the camshaft 101. A bottomed cylindrical recess that opens toward the camshaft 101 is formed at an inner radial side of the inner rotor 2 along a rotational axis X of the camshaft 101. The bottom surface of the recess is brought into contact with the distal end portion of the camshaft 101, thereby to fixedly fasten the inner rotor 2 to the camshaft 101 by a bolt.

The housing 1 includes a front plate 11 mounted facing away from a side connected to the camshaft 101, an outer rotor 12 having a timing sprocket 15 integrally formed therewith, and a rear plate 13 mounted adjacent to the side connected to the camshaft 101. The outer rotor 12 is fitted on the inner rotor 2, which is held between the front plate 11 and the rear plate 13. The front plate 11, outer rotor 12 and rear plate 13 are fastened together through bolts.

Figure 2:
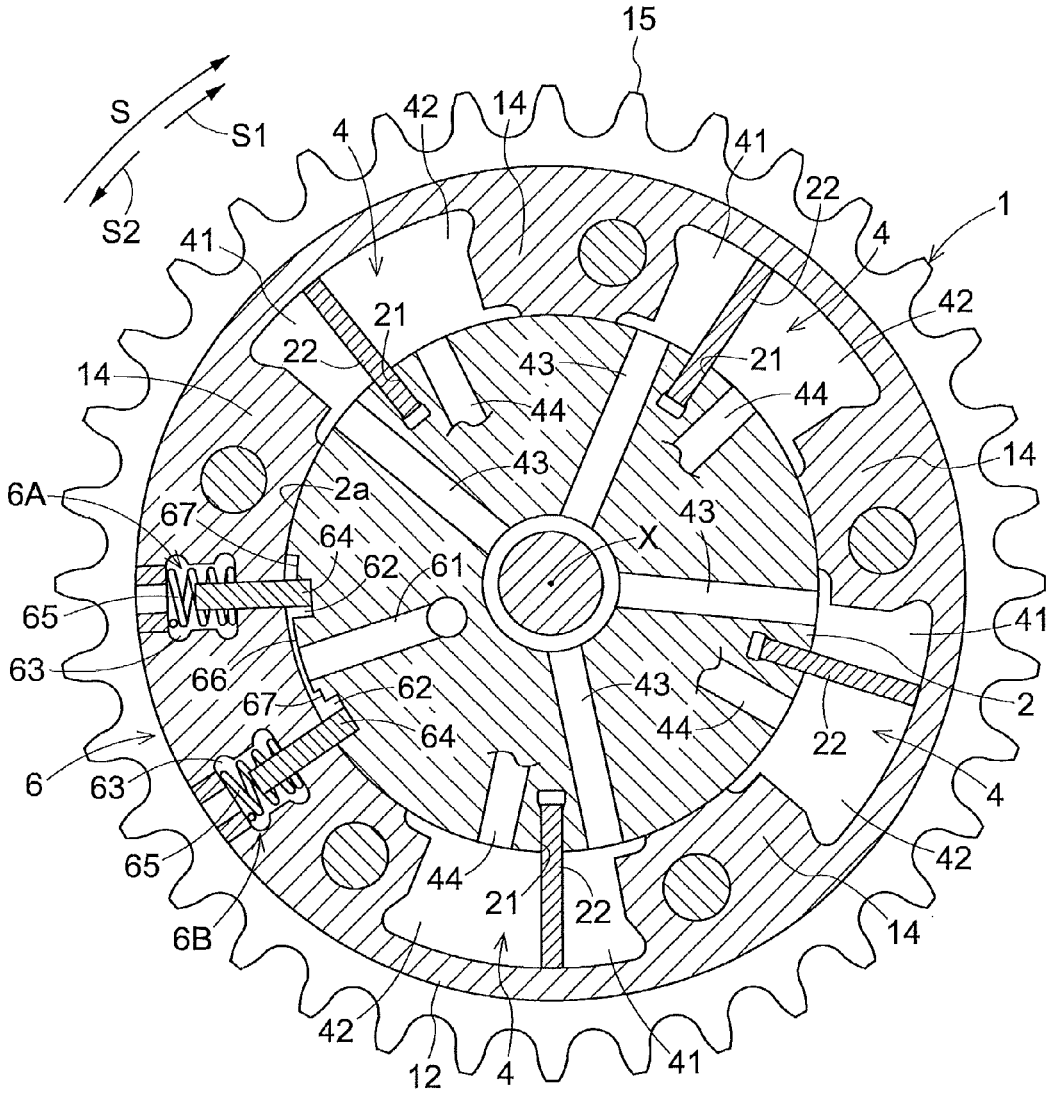
FIG. 2 is a cross section of the valve timing control device in a locking state taken on line II-II of FIG. 1.

When the crankshaft is rotatably driven, a rotational driving force is transmitted to the timing sprocket 15 through a power transmission member 102 to cause the housing 1 to rotate in a rotational direction S shown in FIG. 2. The inner rotor 2 is rotatably driven in the rotational direction S with the rotation of the housing 1 to rotate the camshaft 101. Then, the cam mounted in the camshaft 101 is moved to depress and open the intake valve of the engine.

As shown in FIG. 2, a fluid pressure chamber 4 is defined by the outer rotor 12 and the inner rotor 2. A plurality of projecting portions 14 projecting radially inward are formed in the outer rotor 12 to be spaced from each other along the rotational direction S. Each of the projecting portions 14 functions as a shoe relative to an outer peripheral surface 2*a* of the inner rotor 2. While four fluid pressure chambers 4 are provided in the current embodiment, the number of the fluid pressure chamber is not limited to four.

A vane groove 21 is formed in a portion of the outer peripheral surface 2*a* facing the fluid pressure chamber 4. A vane 22 acting as a "partition" is provided in the vane groove 21 to be directed radially outward. The fluid pressure chamber 4 is divided into an advanced angle chamber 41 and a retarded angle chamber 42 by the vane 22 along the rotational direction S.

As shown in FIGS. 1 and 2, an advanced angle passageway 43 is formed in the inner rotor 2 and the camshaft 101. The advanced angle passageway 43 communicates with each advanced angle chamber 41. Further, a retarded angle passageway 44 is formed in the inner rotor 2 and the camshaft 101. The retarded angle passageway 44 communicates with each retarded angle chamber 42. As shown in FIG. 1, the advanced angle passageway 43 and the retarded angle passageway 44 are connected to a fluid feeding/discharging mechanism 5 described later.

Working fluid is fed to or discharged from or maintained at the advanced angle chamber 41 and the retarded angle chamber 42 by the fluid feeding/discharging mechanism 5, thereby to exert fluid pressure of the working fluid on the vane 22. In this way, the relative rotational phase is displaced in an advanced angle direction or a retarded angle direction, or maintained in a desired phase. More particularly, a displacement force: "(fluid pressure)×(pressure receiving area of vane 22)×(distance between pressure receiving surface center of vane 22 and rotational axis X)×(number of vane 22)" is exerted on the inner rotor 2. This displacement force corresponds to "a displacement force composed of the fluid pressure of the working fluid exerted from the retarded angle chamber side to the partition" of the present invention. It should be noted that the advanced angle direction represents a direction in which the vane 22 is rotationally moved relative to the housing 1 to increase the capacity of the advanced angle chamber 41 and is shown in arrow S1 in FIG. 2. The retarded angle direction S2 represents a direction in which the capacity of the retarded angle chamber 42 is increased and is shown in arrow S2 in FIG. 2.

With the above-noted arrangement, the inner rotor 2 is smoothly rotatable about the rotational axis X relative to the housing 1 within a fixed range. The fixed range in which the housing 1 and the inner rotor 2 are relatively rotatable, that is, a phase difference between the most advanced angle phase and the most retarded angle phase, corresponds to a range in which the vane 22 is displaceable within the fluid pressure chamber 4. Here, the capacity of the retarded angle chamber 42 is maximized in the most retarded angle phase while the capacity of the advanced angle chamber 41 is maximized in the most advanced angle phase.

In the current embodiment, the most retarded angle phase represents a phase in which valve closing timing of the exhaust valve is substantially equal to valve opening timing of the intake valve. Even when the relative rotational phase is at the most retarded angle phase, the engine can be started.

[Locking Mechanism]

The locking mechanism 6 maintains the housing 1 and the inner rotor 2 in a predetermined relative position under the condition in which the fluid pressure of the working fluid is not stable immediately after the engine is started, thereby to restrict the relative rotational phase to a predetermined phase between the most retarded angle phase and the most advanced angle phase (referred to as "locking phase" hereinafter). This allows a rotational phase of the camshaft 101 relative to a rotational phase of the crankshaft to be properly maintained to achieve stable rotation of the engine. In the current embodiment, the locking phase represents a phase in which the valve opening timing of the unillustrated intake valve and the valve opening timing of the unillustrated exhaust valve overlap each other. As a result, hydrocarbon (HC) produced in starting the engine is reduced to provide a low-emission engine.

As shown in FIGS. 1 and 2, the locking mechanism 6 includes a first locking portion 6A and a second locking portion 6B. The first locking portion 6A has a locking passageway 61, a locking groove 62, a storing portion 63, a plate-shaped locking member 64, a spring 65 and a ratchet portion 67.

The locking passageway 61 is formed in the inner rotor 2 and the camshaft 101 to connect the locking groove 62 to a selected port of an oil switching valve 54 described later. The oil switching valve 54 is controlled to allow feed or discharge of the working fluid relative to the locking groove 62 through the locking passageway 61. The locking groove 62 is formed in the outer peripheral surface 2*a* of the inner rotor 2. The ratchet portion 67 has a radial depth smaller than the locking groove 62 and is formed adjacent to the advanced angle side of the locking groove 62. The storing portion 63 is formed in the outer rotor 12. The locking member 64 is disposed in the storing portion 63 and radially projectable or retractable along the contour of the storing portion 63. The spring 65 is disposed in the storing portion 63 to urge the locking member 64 radially inward, that is, toward the locking groove 62.

If the working fluid is discharged from the locking groove when the relative rotational phase is displaced from a phase at the advanced angle side to the locking phase, the locking member 64 engages directly into the locking groove 62. When the locking member 64 engages into the locking groove 62, the relative rotational phase is restricted to a fixed range covering from the locking phase to the phase at the advanced angle side. This range is adjustable by varying a groove width in a circumferential direction of the locking groove 62. When the oil switching valve 54 is controlled to feed the working fluid to the locking groove 62, the locking member 64 is retracted from the locking groove 62 toward the storing portion 63, as a result of which the restriction on the relative rotational phase is released.

If the working fluid is discharged from the locking groove when the relative rotational phase is displaced from a phase at the retarded angle side to the locking phase, the locking member 64 engages into the ratchet portion 67 first, and then into the locking groove 62. As long as the inner rotor 2 makes relative rotation, the period of time in which the locking member 64 faces the locking groove 62 is short, and thus the locking member 64 cannot be necessarily reliably engageable into the locking groove 62. Thus, the provision of the ratchet portion 67 allows the relative rotational phase to be restricted to the fixed range stepwise to converge to the predetermined phase. As a result, the reliability in engaging the locking member 64 into the locking groove 62 is improved.

Normally, the engine is idling immediately before the engine is stopped, the relative rotational phase in the idling state is mostly at a phase in the vicinity of the most retarded angle phase. More particularly, the relative rotational phase is at a phase at the retarded angle side than the locking phase in most cases at the time immediately before the locking mechanism 6 needs to operate to restrict the relative rotational phase to the locking phase. Thus, the ratchet portion 67 is formed in the advanced angle side relative to the locking groove 62.

The second locking portion 6B has a locking passageway 61, a locking groove 62, a storing portion 63, a locking member 64, a spring 65 and a ratchet portion 67. Since the second locking portion 6B has substantially the same construction as the first locking portion 6A, the description about the same part of the construction will be omitted. When the locking member 64 engages into the locking groove 62, the relative rotational phase is restricted to the fixed range covering from the locking phase to the phase at the retarded angle side. The locking groove 62 of the first locking portion 6A and the locking groove 62 of the second locking portion 6B communicate with each other through a communication groove 66 and the ratchet portion 67 of the second locking portion 6B. When the oil switching valve 54 is controlled, the working fluid is fed to the locking groove 62 of the first locking portion 6A, and thus to the locking groove 62 of the second locking portion 6B as well. Then, the locking member 64 is retracted from the locking groove 62 toward the storing portion 63, as a result of which the restriction on the relative rotational phase is released.

With the above-noted structures of the first locking portion 6A and the second locking portion 6B, as shown in FIG. 2, when both of the locking member 64 of the first locking portion 6A and the locking member 64 of the second locking portion 6B are simultaneously engaged into the locking groove 62 of the first locking portion 6A and the locking groove 62 of the second locking portion 6B, respectively, relative rotational movement between both of the rotors 1 and 2 can be restricted while the relative rotational phase can be restricted to the locking phase.

Further, for instance, if each locking groove 62 is structured so that the time when the locking member 64 is engaged into the ratchet portion 67 in the first locking portion 6A may be different from the time when the locking member 64 is engaged into the ratchet portion 67 in the second locking portion 6B, the number of steps in stepwise restriction of the relative rotational phase is increased to improve the operational reliability of the locking mechanism 6.

The shape of the locking member 64 may be pin-shaped other than the plate shape employed in the current embodiment.

[Fluid Feeding/discharging Mechanism]

The construction of the fluid feeding/discharging mechanism 5 will be briefly described hereinafter. As shown in FIG. 1, the fluid feeding/discharging mechanism 5 has an oil pan 51 for reserving engine oil, one example of the "working fluid", an oil pump 52 driven by the engine to feed the engine oil, an oil control valve (OCV) 53 of electromagnetic control type for controlling feed/discharge/maintenance of the engine oil relative to the advanced angle passageway 43 and the retarded angle passageway 44, and the oil switching valve (OSV) 54 of electromagnetic control type for controlling feed and discharge of the engine oil relative to the locking passageway 61. The oil control valve 53 and the oil switching valve 54 are controlled by an ECU 7.

The oil pump 52 is a mechanical-type hydraulic pump driven by a rotational driving force transmitted from the crankshaft. The oil pump 52 draws the engine oil reserved in the oil pan 51 and discharges the same to the downstream side.

The oil control valve 53 is formed as a spool type and operated in response to the control of the amount of power feed performed by the ECU (engine control unit) 7. Switching the oil control valve 53 allows the control for oil supply to the advanced angle chamber 41 and oil discharge from the retarded angle chamber 42, oil discharge from the advanced angle chamber 41 and oil supply to the retarded angle chamber 42, and cutoff of oil supply and oil discharge relative to the advanced angle chamber 41 and the retarded angle chamber 42. The control for feeding the working oil to the advanced angle chamber 41 and discharging the working oil from the retarded angle chamber 42 is referred to as "advanced angle control." When the advanced angle control is performed, the vane 22 is rotatably moved in the advanced angle direction 51 relative to the outer rotor 12, in which the relative rotational phase is displaced toward the advanced angle side. The control for discharging the working oil from the advanced angle chamber 41 and feeding the working oil to the retarded angle chamber 42 is referred to as "retarded angle control." When the retarded angle control is performed, the vane 22 is rotatably moved in the retarded angle direction S2 relative to the outer rotor 12, in which the relative rotational phase is displaced toward the retarded angle side. When the control for cutting off the feed and discharge of the working oil relative to the advanced angle chamber 41 and the retarded angle chamber 42 is performed, the vane 22 is not relatively rotatably moved, thereby to maintain the relative rotational phase in a desired phase.

The oil control valve 53 is configured to determine the degree of opening by adjusting a duty ratio of electric power supplied to an electromagnetic solenoid. This allows fine adjustments of the feeding/discharging amount of the engine oil.

The oil switching valve 54 is formed as a spool type and operated in response to the control of the amount of power feed performed by the ECU (engine control unit) 7. Switching the oil switching valve 54 allows the control for oil supply to the locking groove 62 and oil discharge from the locking groove 62.

[Torsion Spring]

As shown in FIG. 1, the torsion spring 3 is provided between the inner rotor 2 and the front plate 11. The torsion spring 3 acts on the housing 1 and the inner rotor 2 to allow the relative rotational phase to be at the most retarded angle phase. The torsion spring 3 corresponds to the "urging mechanism" of the present invention.

The strength of the urging force of the torsion spring 3 is determined so that the sum of a displacement force and the urging force, the displacement force composed of the engine oil pressure exerted on the vane 22 from the side of the retarded angle chamber 42 when the engine is idling, is greater than a component displacement force applied in the advanced angle direction of a displacement force exerted on the inner rotor 2 based on torque variations of the camshaft 101 when the engine is idling. In addition, the strength of the urging force of the torsion spring 3 is determined so as to be or less than the component displacement force applied in the advanced angle direction of the displacement force exerted on the inner rotor 2 based on the torque variations of the camshaft 101 when the engine is idling. The strength of the urging force is finely adjusted by varying the effective diameter or the number of winds of the torsion spring 3.

With the above-noted arrangement, the urging force of the urging mechanism and an average displacement force applied in the retarded angle direction based on the torque variations of the camshaft 101 are constantly exerted on the inner rotor 2 as a force to relatively rotate and move the inner rotor 2 in the retarded angle direction. Therefore, even if the internal combustion engine is properly started with the relative rotational phase being restricted to the predetermined phase by the locking mechanism 6 and then falls in the idling state to lower the engine oil pressure applied on the vane 22, the urging force of the torsion spring 3 and the average displacement force applied in the retarded angle direction based on the torque variations of the camshaft 101 allow the relative rotational phase to be stabilized at or in the vicinity of the most retarded angle phase. As a result, even if the capacity of the oil pump 52 is reduced, the idling operation can be stabilized.

Further, with the above-noted arrangement, a component displacement force applied in the advanced angle direction of the displacement force based on the torque variations of the camshaft 101 is canceled by the urging force of the torsion spring 3. Thus, the inner rotor 2 is free from clattering, which achieves more stable idling operation.

[Other Structures]

Although not shown, there are provided a crank angle sensor for detecting a rotational angle of the crankshaft of the engine, and a camshaft angle sensor for detecting a rotational angle of the camshaft 101. The ECU 7 is configured to detect the relative rotational phase based on detected results received from the crank angle sensor and the camshaft angle sensor to determine in which side of the locking phase, the retarded angle side or the advanced angle side, the relative rotational phase is present.

Although not shown, a signal system is formed in the ECU 7 for obtaining information on the ON/OFF state of an ignition key and information from an oil temperature sensor for detecting the temperature of the engine oil, for example. Further, the ECU 7 has a memory that stores control information for the optimal relative rotational phase determined in response to the operating state of the engine. The ECU 7 is configured to control the relative rotational phase based on the information on the operating state (engine rotational speed, cooling water temperature, etc.) and the above-noted control information.

[Operation of Valve Timing Control Device]

Figure 3:
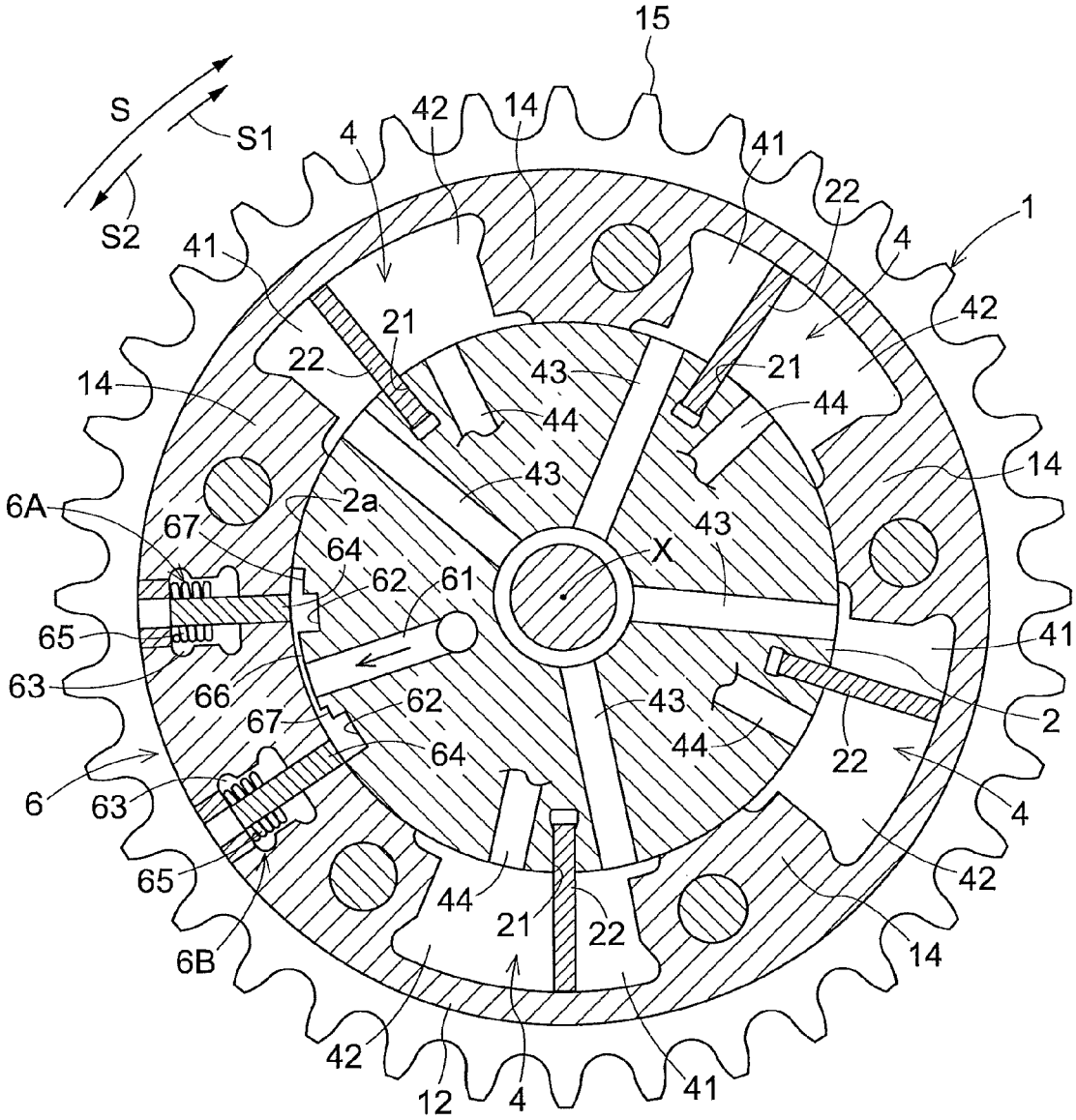
FIG. 3 is a cross section of the valve timing control device when the locking state of FIG. 2 is released.

As noted above, the valve timing control device of the present invention is configured to start the engine with the relative rotational phase being restricted to the locking phase by the locking mechanism 6 as shown in FIG. 2. When the engine is properly started, the locking member 64 is retracted from the locking groove 62 by controlling the oil control valve 53 to feed the engine oil to the locking groove 62, thereby to release the restriction on the relative rotational phase by the locking mechanism 6 as shown in FIG. 3.

Figure 4:
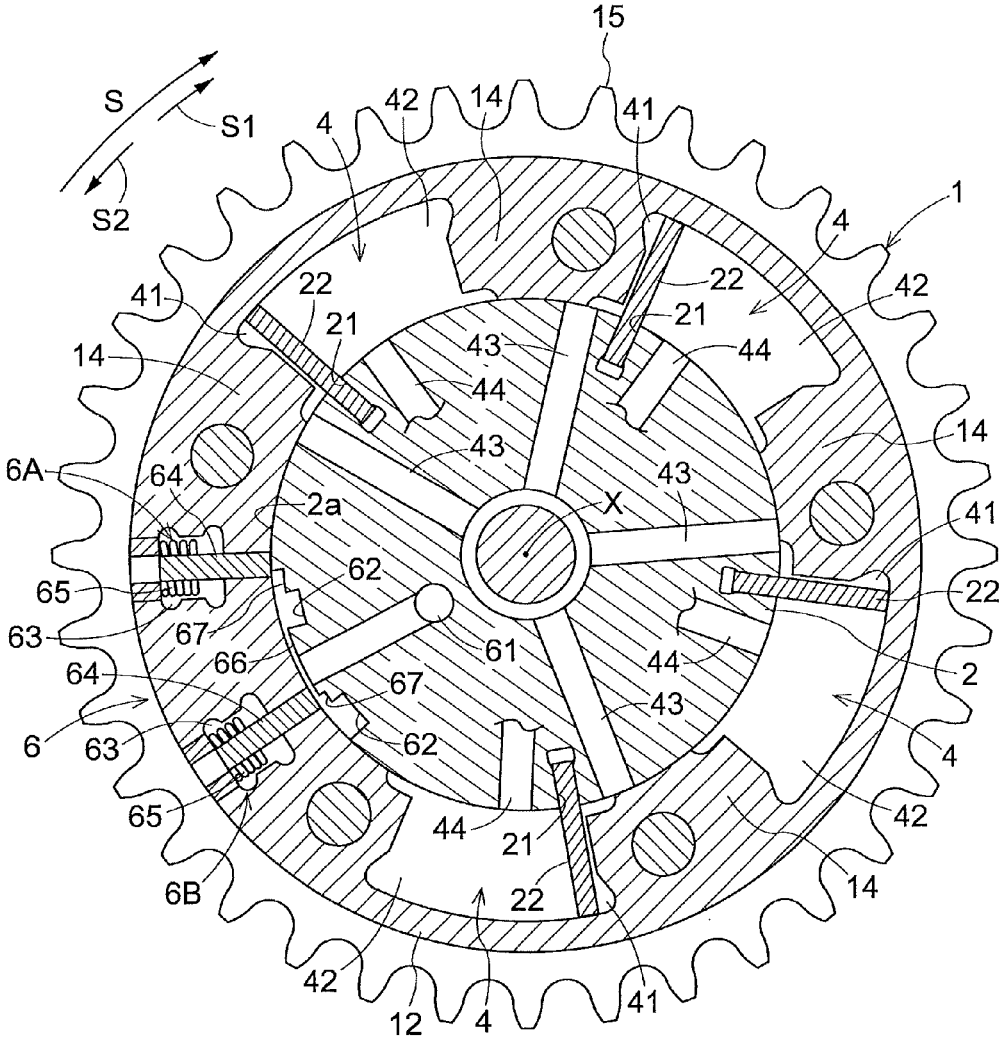
FIG. 4 is a cross section of the valve timing control device in which a relative rotational phase is at a phase in the vicinity of a most retarded angle phase.

Then, as shown in FIG. 4, the relative rotational phase is displaced to a phase in the vicinity of the most retarded angle phase suitable for the idling operation. In this state, the inner rotor 2 is urged to the most regarded direction by the urging force of the torsion spring 3, which prevents the inner rotor 2 from clattering and stabilizes the relative rotational phase to achieve the stable idling operation.

Figure 5:
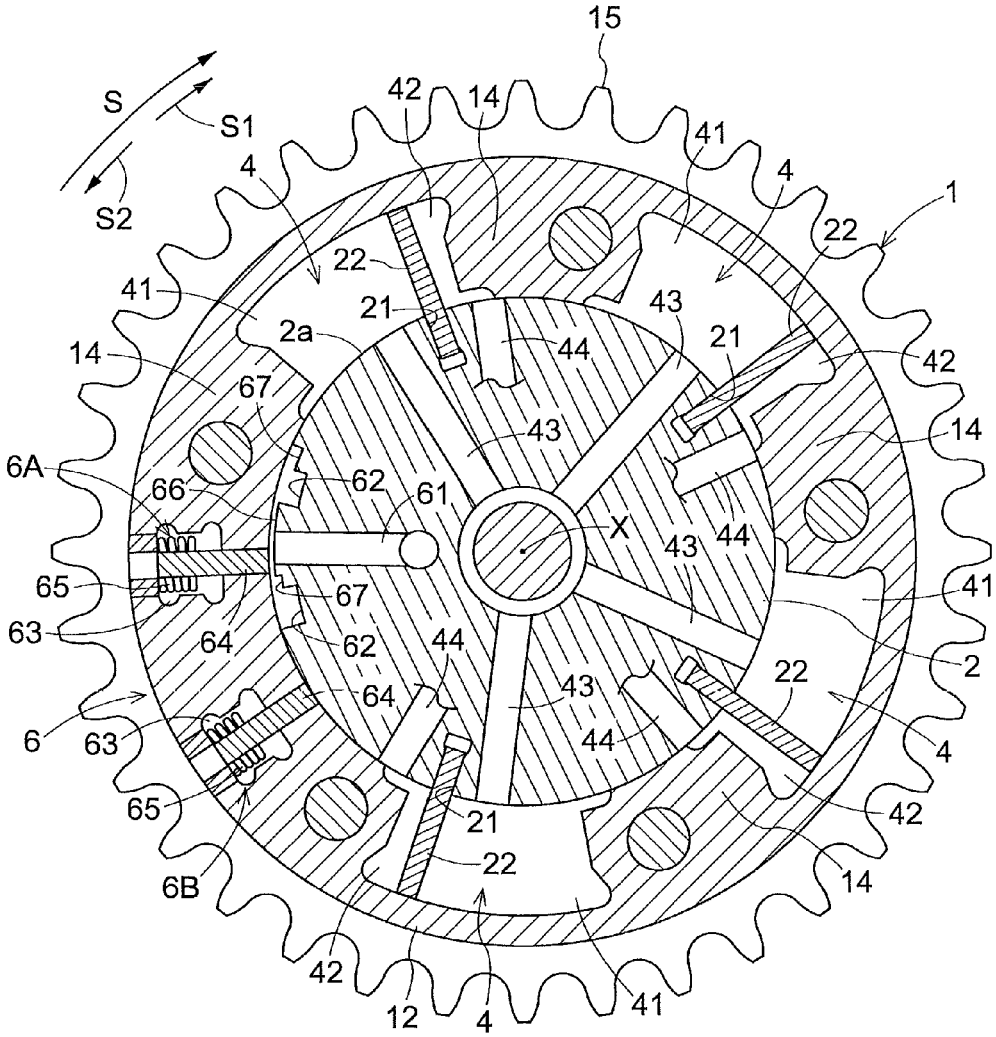
FIG. 5 is a cross section of the valve timing control device in which the relative rotational phase is at a phase in an advanced angle side in reference to the locking phase.

Then, when a normal driving state is established, the relative rotational phase is displaced to the phase adjacent to the retarded angle side in reference to the locking phase as shown in FIG. 4 or to the phase adjacent to the advanced angle side in reference to the locking phase as shown in FIG. 5, in response to the load or rotational speed of the engine.

When the ignition key is turned off to stop the engine, the oil pump 52 is also stopped and the feed/discharge of the engine oil relative to the retarded angle chamber 42 and the advanced angle chamber 41 is stopped as well. As a result, the engine oil pressure applied to the vane 22 is correspondingly reduced. On the other hand, even if the engine stopped, it takes some time for the camshaft 101 to completely come to stop. Thus, the displacement force based on the torque variations of the camshaft 101 is exerted on the inner rotor 2. In this case, since the component displacement force applied in the advanced angle direction of the displacement force based on the torque variations of the camshaft 101 is greater than the urging force of the torsion spring 3 applied in the retarded angle direction, the inner rotor 2 would clatter relative to the housing 1. Such clattering causes the relative rotational phase to be displaced in the vicinity of the locking phase. As a result, the relative rotational phase is restricted to the locking phase by the locking mechanism 6. In this way, the relative rotational phase can be restricted to the locking phase based on the normal operation of the valve timing control device.

When an atmospheric temperature is low, for example, the engine would sometimes stall at the low-speed rotation side in which the driving condition of the engine is unstable. In such a case, it is required to displace the relative rotational phase to the locking phase in order to restart the engine. On the other hand, when the engine is rotated at low speed, the relative rotational phase is at a phase in the vicinity of the most retarded angle phase in many cases. When the engine is restarted, the camshaft 101 is rotated by cranking, as a result of which the displacement force based on the torque variations of the camshaft 101 is exerted on the inner rotor 2. Thus, the inner rotor 2 would clatter. This causes the locking member 64 to engage into the ratchet portion 67 and further into the locking groove 62.

Even if the relative rotational phase is not restricted to the locking phase when the engine is stopped or restarted after stalling, no serious problem would occur because the engine used in the current embodiment can be started even when the relative rotational phase is at the most retarded angle phase.

[Modification]

Figure 6:
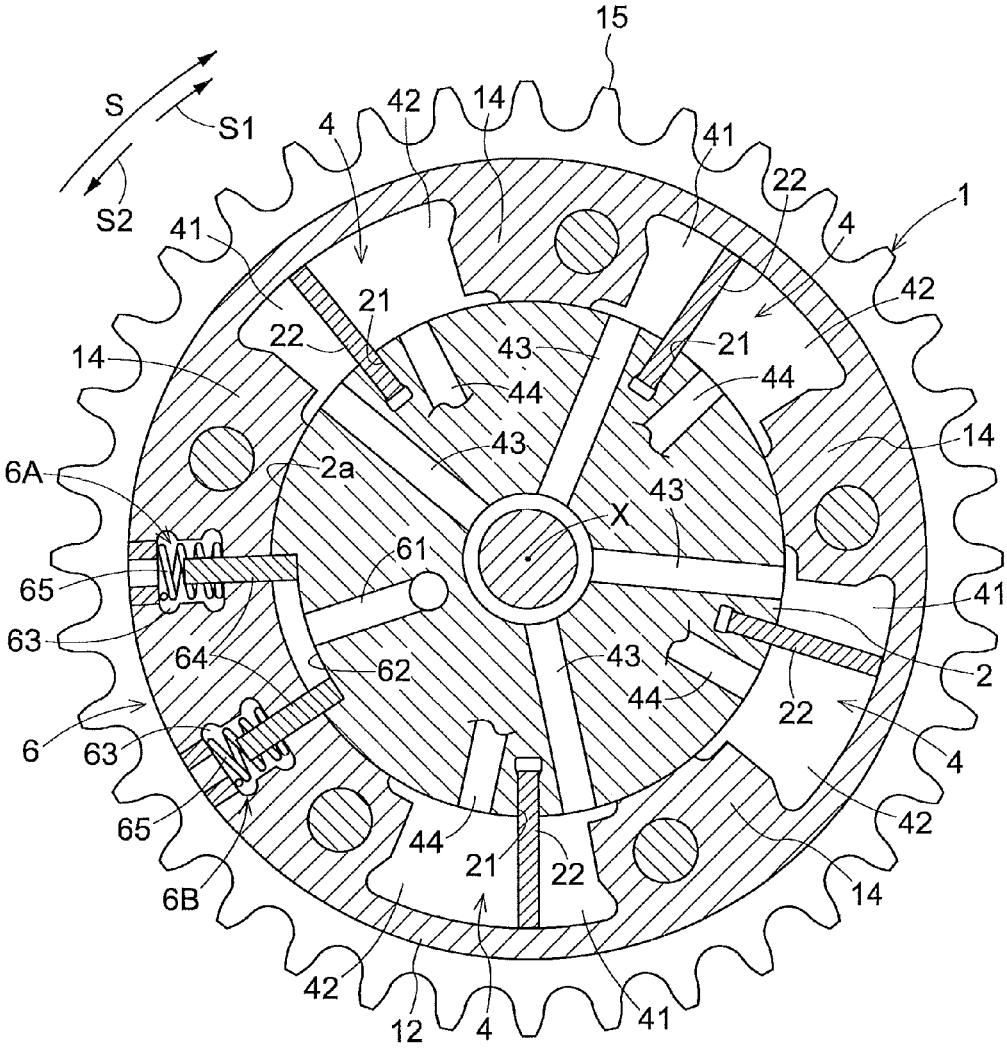
FIG. 6 is a cross section of the valve timing control device in the locking state according to a modified embodiment.
Figure 7:
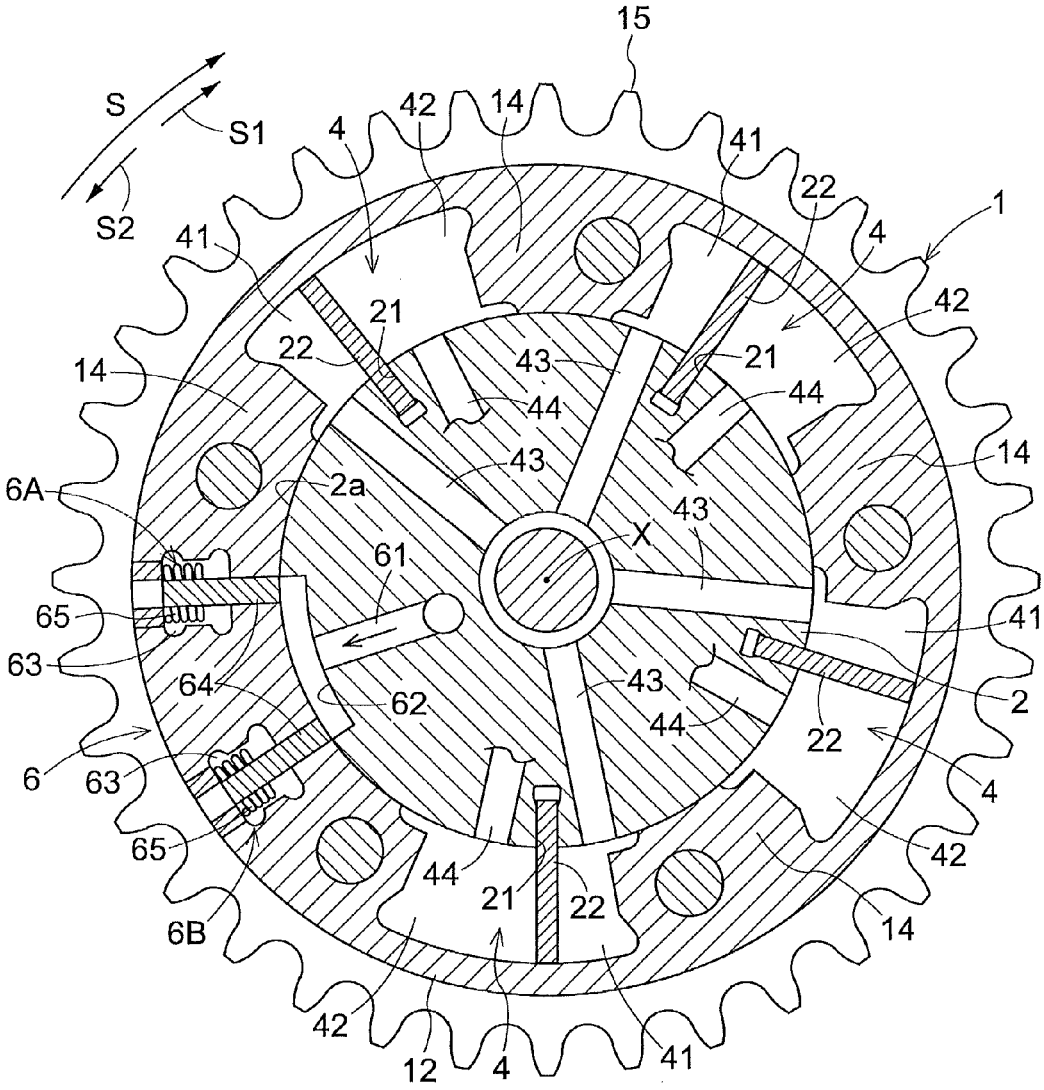
FIG. 7 is a cross section of the valve timing control device in the modified embodiment when the locking state of FIG. 6 is released.
Figure 8:
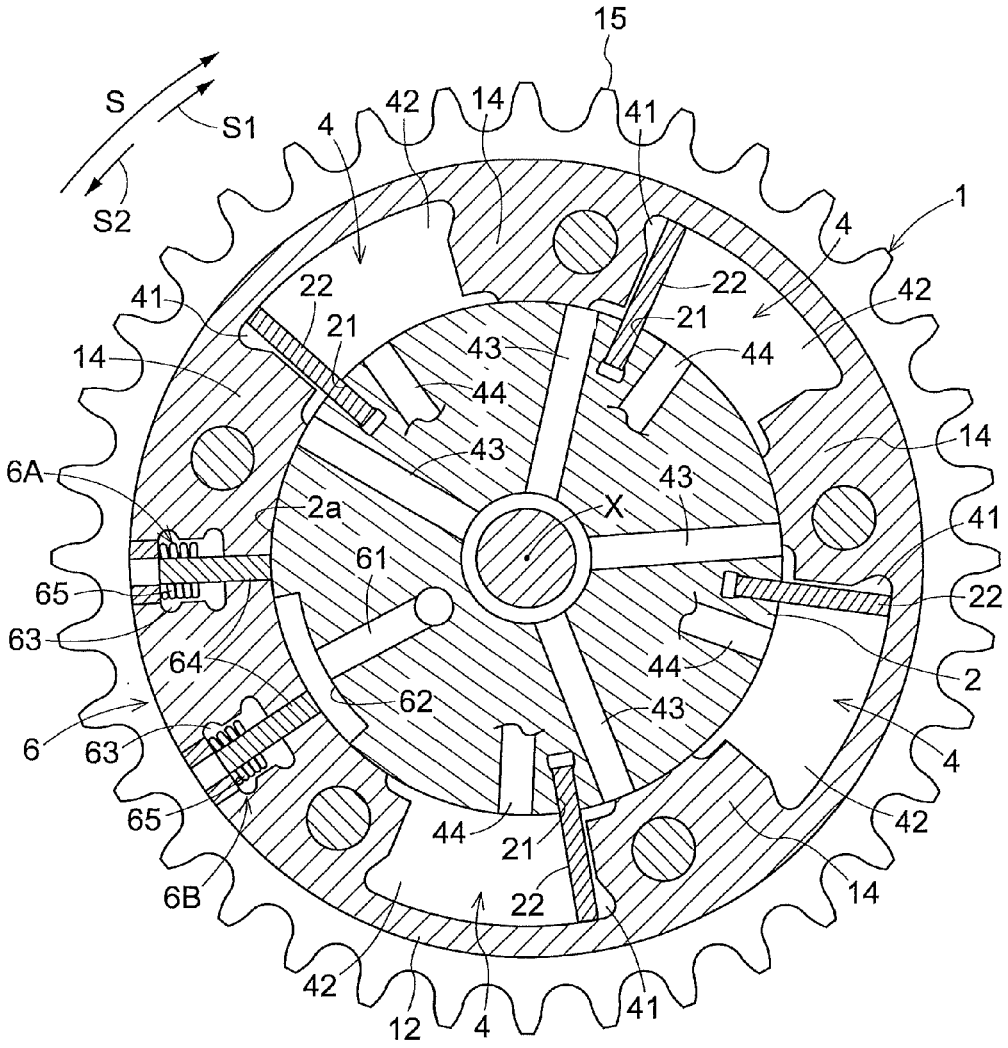
FIG. 8 is a cross section of the valve timing control device in the modified embodiment when the relative rotational phase is at a phase in the vicinity of a most retarded angle phase.
Figure 9:
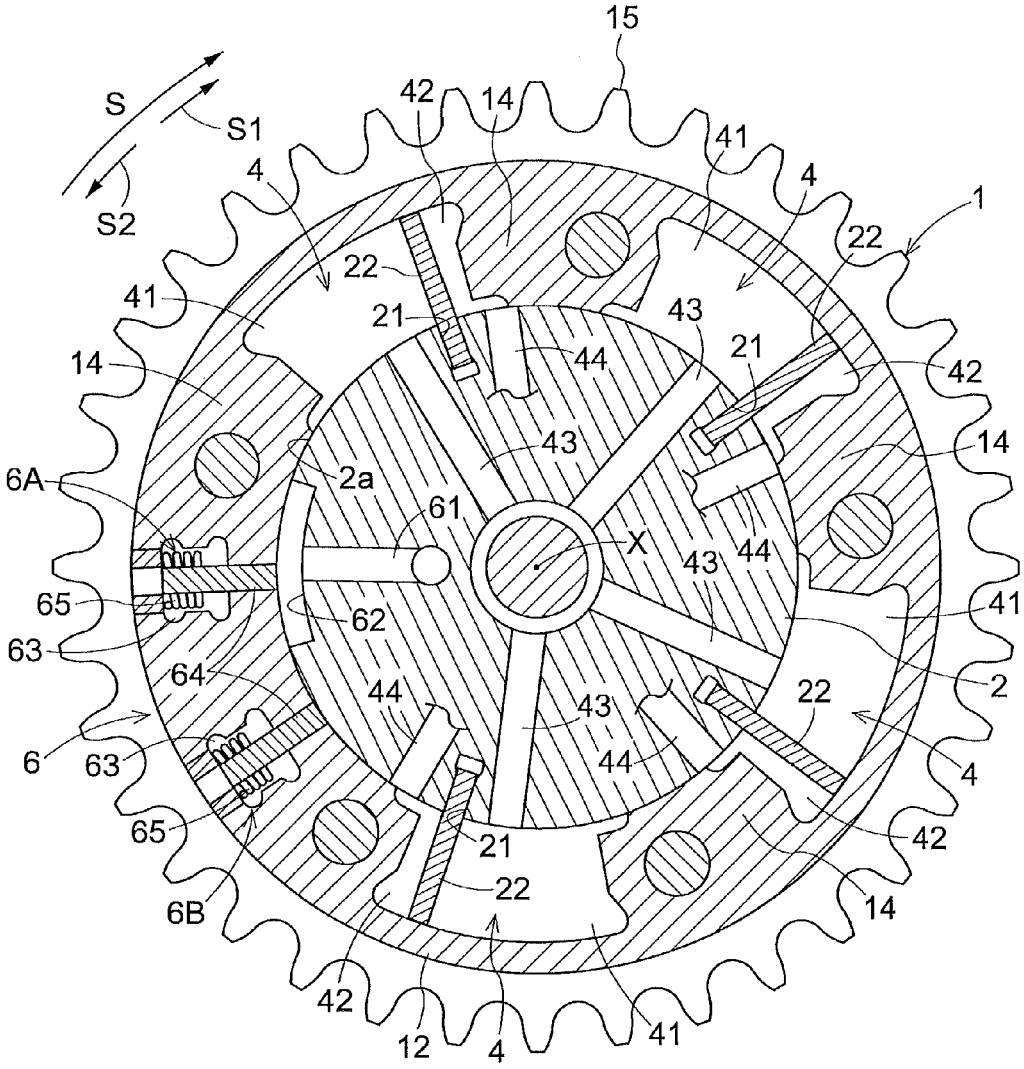
FIG. 9 is a cross section of the valve timing control device in the modified embodiment when the relative rotational phase at the phase in the advanced angle side in reference to the locking phase.

A modified embodiment of the valve timing control device relating to the present invention will be described hereinafter in reference to FIGS. 6 to 9. FIG. 6 is a sectional view corresponding to FIG. 2 of the above-noted embodiment in which the valve timing control device is in the locking state. FIGS. 7 through 9 are sectional views of the valve timing control device in the idling state and in the normal driving state. FIG. 7 is a sectional view showing the state in which the locking state established by the locking mechanism 6 is released. FIG. 8 is a sectional view of the valve timing control device in which the relative rotational phase is at a phase in the vicinity of the most retarded angle phase. FIG. 9 is a sectional view of the valve timing control device in which the relative rotational phase is at a phase of the advanced angle side in reference to the locking phase. The descriptions on the same constructions as those of the above-noted embodiment will be omitted. The like reference numbers will be assigned to the like portions or elements. The modified embodiment is different from the above-noted embodiment in determined value of the strength of the urging force of the torsion spring and in construction of the locking mechanism 6.

[Locking Mechanism]

The locking mechanism 6 includes a first locking portion 6A and a second locking portion 6B as shown in FIGS. 1 and 6. Each of the first locking portion 6A and the second locking portion 6B includes a locking passageway 61, a locking groove 62, a storing portion 63, a plate-shaped locking member 64, and a spring 65. The first locking portion 6A and the second locking portion 6B share the locking groove 62.

The locking passageway 61 connects the locking groove 62 to a selected port of an oil switching valve 54. The oil switching valve 54 is controlled to allow feed/discharge of the working fluid relative to the locking groove 62 through the locking passageway 61.

When the relative rotational phase is displaced from the advanced angle side to the locking phase, the locking members 64 of both of the first locking portion 6A and the second locking portion 6B engage into the locking groove 62 if the working fluid is discharged from the locking groove. When the locking members 64 engage into the locking groove 62, the relative rotational movement of the inner rotor 2 is stopped and the relative rotational phase is restricted to the locking phase. When the oil switching valve 54 is controlled to feed the working fluid to the locking groove 62, both of the locking members 64 are retracted from the locking groove 62 toward the storing portions 63, thereby to release the restriction on the relative rotational phase.

[Torsion Spring]

The strength of the urging force of the torsion spring 3 is determined to be at or greater than the component displacement force applied in the advanced angle direction of the displacement force exerted on the inner rotor 2 based on the torque variations of the camshaft 101 when the engine is idling.

With such an arrangement, the urging force of the urging mechanism and an average displacement force applied in the retarded angle direction based on the torque variations of the camshaft 101 are constantly exerted on the inner rotor 2 as a force to relatively rotate and move the inner rotor 2 in the retarded angle direction. Therefore, even if the internal combustion engine is properly started with the relative rotational phase being restricted to the predetermined phase by the locking mechanism 6 and then falls in the idling state to lower the engine oil pressure applied on the vane 22, the urging force of the torsion spring 3 and the average displacement force applied in the retarded angle direction based on the torque variations of the camshaft 101 allow the relative rotational phase to be stabilized at or in the vicinity of the most retarded angle phase. As a result, even if the capacity of the oil pump 52 is reduced, the idling operation can be stabilized.

Further, with the above-noted arrangement, the component displacement force applied in the advanced angle direction of the displacement force based on the torque variations of the camshaft 101 is canceled by the urging force of the torsion spring 3. Thus, the inner rotor 2 is free from clattering, which achieves more stable idling operation.

[Operation of Valve Timing Control Device]

The operations of the valve timing control device when the engine is started and is in the normal driving state are the same as in the above-noted embodiment, and thus will not be described here. In the current embodiment, delay control is performed when the engine stopped. More particularly, when the ignition key is turned off, the ECU 7 gives an instruction to feed the engine oil to the advanced angle chamber 41. The ECU 7 gives an instruction to stop the engine when it determines that the relative rotational phase is restricted to the locking phase as shown in FIG. 6. On the other hand, when the engine is restarted after being stopped in an abnormal state such as stalling, the ECU 7 controls to place the relative rotational phase in the locking phase when it determines that the relative rotational phase is not restricted to the locking phase. In this way, the relative rotational phase is reliably restricted to the locking phase by the action of the locking mechanism 6, and thus the engine is started at a preferable phase to achieve low emissions.

INDUSTRIAL APPLICABILITY

The present invention is applicable to a valve timing control device of an internal combustion engine of an automobile or others.

DESCRIPTION OF THE REFERENCE MARKS

1 a housing (a drive-side rotational member)
2 an inner rotor (a driven-side rotational member)
3 a torsion spring (an urging mechanism)
4 a fluid pressure chamber
5 a fluid feeding/discharging mechanism
6 a locking mechanism
22 a vane (a partition)
41 an advanced angle chamber
42 a retarded angle chamber
101 a camshaft

The invention claimed is:

1. A valve timing control device comprising:

a drive-side rotational member synchronously rotatable with a crankshaft of an internal combustion engine;

a driven-side rotational member mounted coaxially with the drive-side rotational member and synchronously rotatable with a camshaft for opening and closing a valve of the internal combustion engine;

a fluid pressure chamber defined by the drive-side rotational member and the driven-side rotational member;

a partition provided in at least one of the drive-side rotational member and the driven-side rotational member for dividing the fluid pressure chamber into a retarded angle chamber and an advanced angle chamber;

a fluid feeding/discharging mechanism for controlling feed/discharge of working fluid relative to the fluid pressure chamber;

a locking mechanism for restricting a relative rotational phase of the driven-side rotational member relative to the drive-side rotational member to a predetermined phase between a most retarded angle phase and a most advanced angle phase; and an urging mechanism for constantly exerting an urging force to the drive-side rotational member and the driven-side rotational member to displace the relative rotational phase to the side of the most retarded angle phase, wherein the strength of the urging force is determined in such a manner that a sum of the urging force and a displacement force composed of fluid pressure of the working fluid exerted on the partition from the side of the retarded angle chamber when the internal combustion engine is driven at a predetermined rotational speed, is greater than a component displacement force applied in an advanced angle direction of a displacement force exerted on the driven-side rotational member based on torque variations of the camshaft when the internal combustion engine is driven at the predetermined rotational speed, and that the urging force is equal to or less than the component displacement force applied in the advanced angle direction of the displacement force exerted on the driven-side rotational member based on the torque variations of the camshaft when the internal combustion engine is driven at the predetermined rotational speed.

2. The valve timing control device as claimed in claim 1, wherein the internal combustion engine is capable of being started when the relative rotational phase is at the most retarded angle phase.

3. A valve timing control device comprising:

a drive-side rotational member synchronously rotatable with a crankshaft of an internal combustion engine;

a driven-side rotational member mounted coaxially with the drive-side rotational member and synchronously rotatable with a camshaft for opening and closing a valve of the internal combustion engine;

a fluid pressure chamber defined by the drive-side rotational member and the driven-side rotational member;

a partition provided in at least one of the drive-side rotational member and the driven-side rotational member for dividing the fluid pressure chamber into a retarded angle chamber and an advanced angle chamber;

a fluid feeding/discharging mechanism for controlling feed/discharge of working fluid relative to the fluid pressure chamber;

a locking mechanism for restricting a relative rotational phase of the driven-side rotational member relative to the drive-side rotational member to a predetermined phase between a most retarded angle phase and a most advanced angle phase; and an urging mechanism for constantly exerting an urging force to the drive-side rotational member and the driven-side rotational member to displace the relative rotational phase to the side of the most retarded angle phase, wherein the strength of the urging force is determined to be at or greater than a component displacement force applied in an advanced angle direction of a displacement force exerted on the driven-side rotational member based on torque variations of the camshaft when the internal combustion engine is driven at the predetermined rotational speed.

4. The valve timing control device as claimed in claim 3, wherein the internal combustion engine is capable of being started when the relative rotational phase is at the most retarded angle phase.

* * * * *